US008241003B2

(12) United States Patent
Roberge

(10) Patent No.: US 8,241,003 B2
(45) Date of Patent: Aug. 14, 2012

(54) SYSTEMS AND METHODS INVOLVING LOCALIZED STIFFENING OF BLADES

(75) Inventor: Gary D. Roberge, Tolland, CT (US)

(73) Assignee: United Technologies Corp., Hartford, CT (US)

( * ) Notice: Subject to any disclaimer, the term of this patent is extended or adjusted under 35 U.S.C. 154(b) by 1240 days.

(21) Appl. No.: 12/018,259

(22) Filed: Jan. 23, 2008

(65) Prior Publication Data

US 2009/0185911 A1 Jul. 23, 2009

(51) Int. Cl.
*F01D 5/14* (2006.01)

(52) U.S. Cl. ..... 416/229 R; 416/229 A; 416/236 R; 416/241 R; 416/230; 416/241 B

(58) Field of Classification Search ..... 416/224, 416/229, 230, 229 A, 241 B, 229 R, 236 R, 416/241 R See application file for complete search history.

(56) References Cited

U.S. PATENT DOCUMENTS

| | | | | |
|---|---|---|---|---|
| 3,699,623 | A | 10/1972 | Kreider | |
| 3,748,721 | A | 7/1973 | Alexander | |
| 4,010,884 | A | 3/1977 | Rothman | |
| 4,081,220 | A | 3/1978 | Andrews | |
| 4,247,258 | A | 1/1981 | Griffee, Jr. et al. | |
| 4,782,992 | A | 11/1988 | Doble | |
| 4,827,712 | A * | 5/1989 | Coplin | 60/226.1 |
| 4,900,599 | A | 2/1990 | Doble | |
| 5,248,242 | A | 9/1993 | Lallo et al. | |
| 5,366,570 | A * | 11/1994 | Mazur et al. | 148/669 |
| 5,843,354 | A | 12/1998 | Evans et al. | |
| 5,931,641 | A * | 8/1999 | Finn et al. | 416/229 A |
| 6,852,273 | B2 | 2/2005 | Ivanov et al. | |
| 7,104,760 | B2 * | 9/2006 | Burdgick | 416/224 |
| 7,600,979 | B2 * | 10/2009 | Steibel et al. | 416/230 |
| 7,828,526 | B2 * | 11/2010 | Cairo et al. | 416/224 |
| 7,841,834 | B1 * | 11/2010 | Ryznic | 416/224 |

OTHER PUBLICATIONS

U.S. Appl. No. 11/951,614 entitled Gas Turbine Engine Systems Involving Tip Fans, Inventors: Gary D. Roberge and Gabriel L. Suciu filed on Dec. 5, 2007.

U.S. Appl. No. 11/950,665 entitled Gas Turbine Engine Systems Involving Tip Fans, Inventors: Gary D. Roberge and Gabriel L. Suciu filed on Dec. 5, 2007.

U.S. Appl. No. 11/936,828 entitled Gas Turbine Engine Systems Involving Adaptive Fans, Inventors: Gary D. Roberge and Gabriel L. Suciu filed on Nov. 8, 2007.

* cited by examiner

*Primary Examiner* — Ninh H Nguyen

(57) ABSTRACT

Systems and methods involving localized stiffening of blades are provided. In this regard, a representative a gas turbine engine blade includes: a recess located in a surface of the blade; and material positioned at least partially within the recess such that the material provides a localized increase in stiffness of the blade.

18 Claims, 3 Drawing Sheets

SYSTEMS AND METHODS INVOLVING LOCALIZED STIFFENING OF BLADES

BACKGROUND

1. Technical Field

The disclosure generally relates to gas turbine engines.

2. Description of the Related Art

Rotating blades of gas turbine engines operate in varying environments and at varying speeds of rotation. Under some operating conditions, the blades may deform elastically, such as by bending due to aerodynamic forces. In some applications, such bending may be undesirable in order to prevent coupling with steady or unsteady aerodynamic forces, thereby driving high cycle fatigue and/or poor aerodynamic performance.

SUMMARY

Systems and methods involving localized stiffening of blades are provided. In this regard, an exemplary embodiment of a gas turbine engine blade comprises: a recess located in a surface of the blade; and material positioned at least partially within the recess such that the material provides a localized increase in stiffness of the blade.

An exemplary embodiment of a gas turbine engine comprises: a blade having a surface; a recess located in the surface of the blade; and material positioned at least partially within the recess such that the material provides a localized increase in stiffness of the blade.

An exemplary embodiment of a method comprises stiffening discrete portions of a blade of a gas turbine engine such that aero-elastic tuning of the blade is facilitated.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Systems and methods involving localized stiffening of blades are provided, several exemplary embodiments of which will be described in detail. In some embodiments, the blades are fan blades of a gas turbine engine, with the blades being stiffened in selected areas in order to reduce a tendency of the blades to exhibit unwanted deflections. In some of these embodiments, stiffening of the selected areas can be accomplished by forming recesses in the exterior surfaces of the blades and bonding material of higher stiffness than the base material of the blades within the recesses. Additionally or alternatively, selected stiffening can be provided to an interior of a blade, such as by providing a material-filled recess on an interior wall that defines a hollow portion of the blade.

Figure 1:
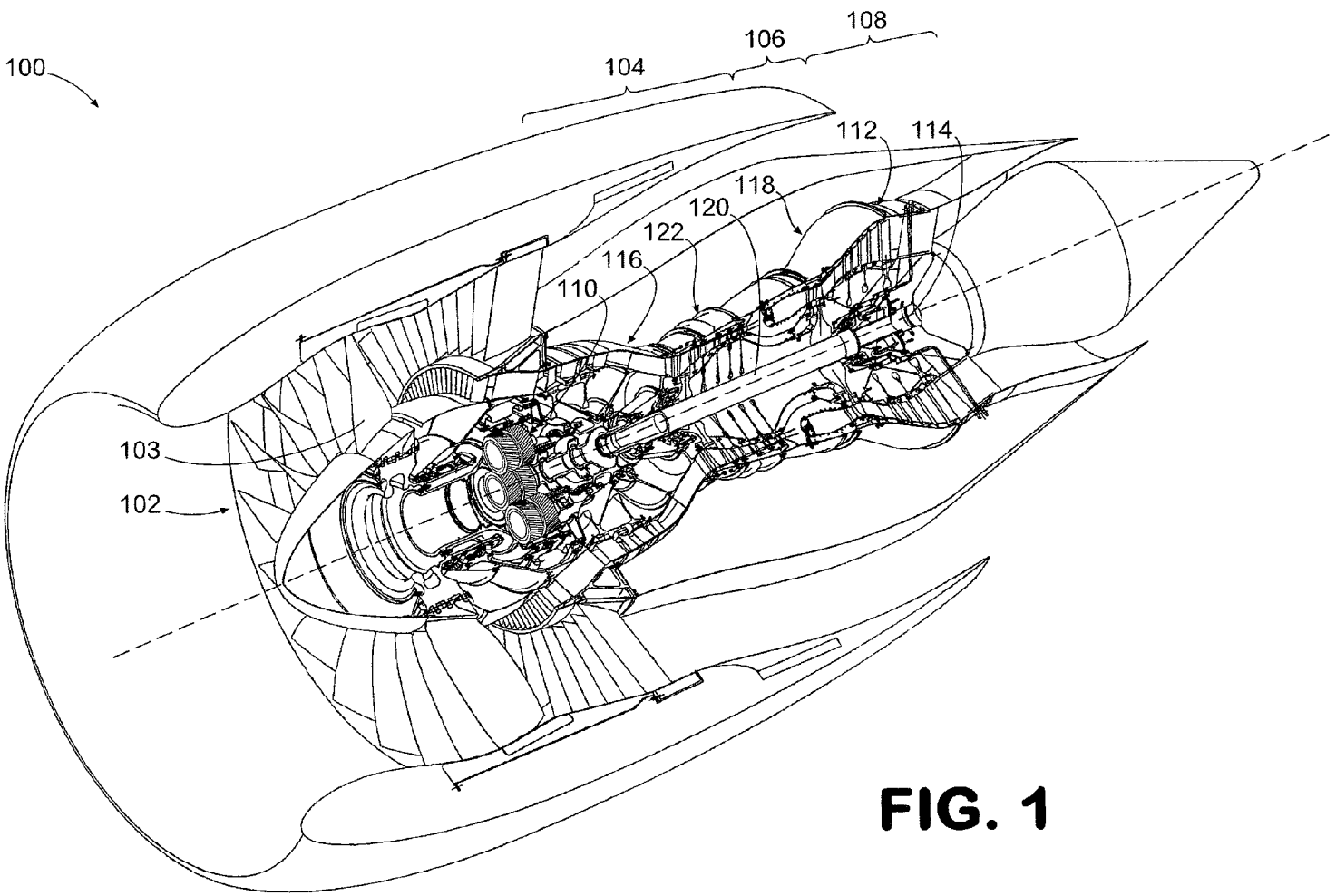
FIG. 1 is a schematic diagram depicting an exemplary embodiment of a gas turbine engine.

In this regard, reference is made to the schematic diagram of FIG. 1, which depicts an exemplary embodiment of a gas turbine engine. As shown in FIG. 1, engine 100 is depicted as a turbofan that incorporates a multi-stage fan 102, a compressor section 104, a combustion section 106 and a turbine section 108. Although depicted as a turbofan gas turbine engine, it should be understood that the concepts described herein are not limited to use with turbofans as the teachings may be applied to other types of gas turbine engines.

As shown in FIG. 1, fan 102 includes rotatable blades (e.g., blade 103), with the sets of blades being powered by a differential gear assembly 110. The differential gear assembly 110 is coupled to a low-pressure turbine 112 via shaft 114. In addition to providing torque for rotating the fan, low-pressure turbine 112 powers a low-pressure compressor 116. Low-pressure turbine 112 is located downstream of a high-pressure turbine 118 that is connected through shaft 120 to a high-pressure compressor 122. The combustion section 106 is located downstream of the high-pressure compressor and upstream of the high-pressure turbine.

The use of localized stiffening of blades may be particularly relevant (although not exclusively) to use in gas turbine engines incorporating geared fans, e.g., fan 102, as the relatively slow rotational speeds of such fans may render the blades of the fans susceptible to unwanted deflections. This may be attributable, at least in part, to reduced tip speeds of the blades and associated fan pressure ratio. In this regard, aerodynamic loading of the blades coupled with the structural characteristics of the airfoil could cause the blades to twist or otherwise deflect elastically. In some circumstances, such deflections could result in blade flutter, which is a self-excited vibratory (typically torsional) mode created by a coupling of steady and/or unsteady aerodynamic forces with a vibratory response characteristic of the blade, which, if left unchecked, can result in cracking or blade failure, for example. Notably, deflections may occur for other reasons, such as the transient condition of a birdstrike, for example.

Figure 2:
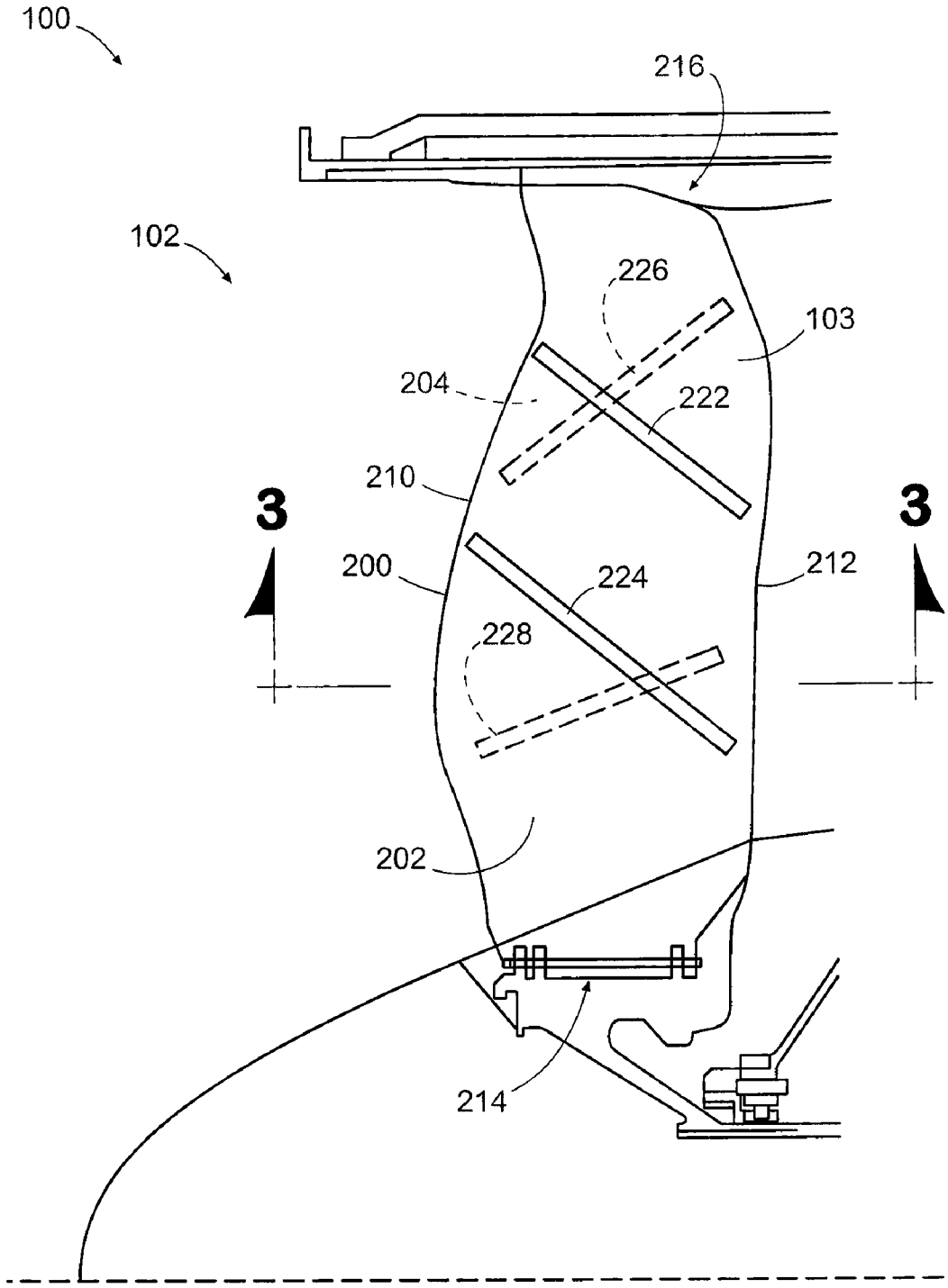
FIG. 2 is a schematic diagram depicting a portion of the embodiment of FIG. 1.

FIG. 2 is a schematic diagram depicting a portion of the gas turbine engine of FIG. 1 and, in particular, blade 103 of fan 102. In FIG. 2, the pressure side 202 of the blade is visible, with the view of suction side 204 being obstructed. Notably, blade 103 extends between a leading edge 210, a trailing edge 212, a root 214 and a tip 216. Blade 103 also incorporates multiple areas of localized stiffening. Specifically, pressure side 202 includes stiffened areas 222, 224, and suction side 204 includes stiffened areas 226, 228. It should be noted that the stiffened areas are representative in nature, and various other numbers, sizes, shapes, locations (e.g., internal and/or external) and/or orientations of stiffened areas can be used in other embodiments.

In the embodiment of FIG. 2, each of the stiffened areas is generally elongate and rectangular. Each of the stiffened areas also generally spans a substantial portion of the distance between the leading and trailing edges of the blade. With respect to stiffened areas 222, 224 located on pressure side 202, these areas are generally parallel to each other, whereas stiffened areas 226, 228 located on the suction side 204 are not parallel to each other. Moreover, the stiffening area 222 and the stiffening area 226 are oriented substantially not parallel to each other, and the stiffening area 224 and the stiffening area 228 are oriented substantially not parallel to each other.

The quantities, dimensions, characteristics, and stiffness characteristics of the stiffened areas, as well as the orientation of the stiffened areas can be based on one or more of a variety of factors. These factors may include, but are not limited to, airfoil material, airfoil physical size, thickness (which relates to torsional natural frequency drivers), solid vs. hollow, aerodynamic loading (e.g., pressure ratio), flow velocity and/or the presence of upstream and/or downstream vibratory drivers, for example.

Figure 3:
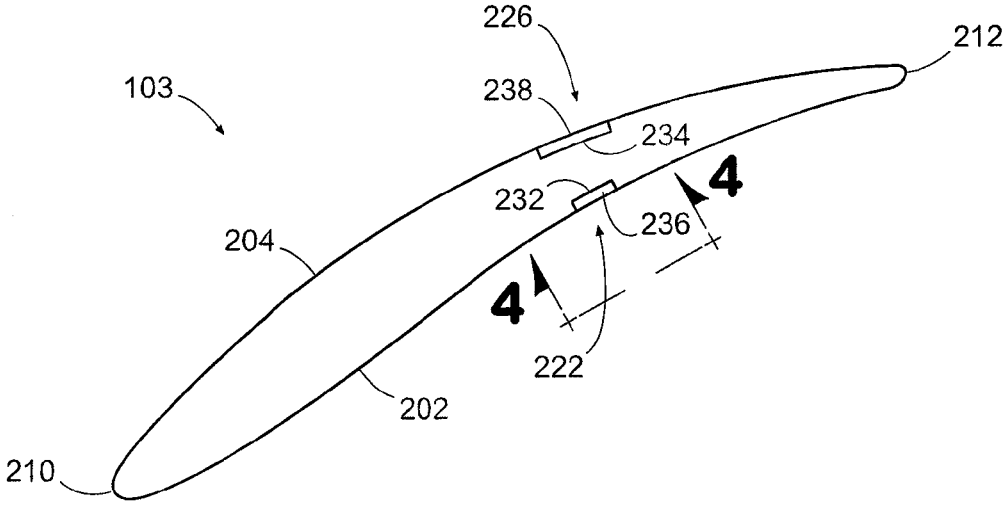
FIG. 3 is a cross-sectional view of the fan blade of FIG. 2, viewed along section line 3-3.

As shown in FIG. 3, stiffened areas 222 and 226 of blade 103 are formed by provisioning the exterior surface of the blade with recesses. In this regard, recesses 232 and 234 are depicted in FIG. 3, each of which serves as a mounting location for stiffening material. In this case, material 236 is positioned at least partially within recess 232 and material 238 is positioned at least partially within recess 234.

The recesses can be formed by a variety of techniques. By way of example, such techniques can include, but are not limited to, machine milling and electro-discharge milling. In the embodiment of FIG. 3, each of the recesses exhibits a generally rectangular cross-section, although various other shapes can be used in other embodiments.

Various materials can be received within the recesses for providing localized stiffening. By way of example, such materials can include, but are not limited to, composite materials. For instance, single or multi-layer unidirectional titanium and silicon carbide fiber tape (e.g., SCS-6 and Ti 6-4 manufactured by 3M®) could be used. As another example, alumina fiber in an aluminum matrix to form a unidirectional tape could be used, among others.

Figure 4:
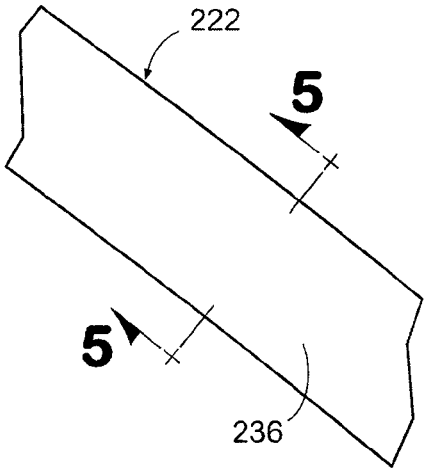
FIG. 4 is a cross-sectional view of a portion of the fan blade of FIG. 3, viewed along section line 4-4.
Figure 5:
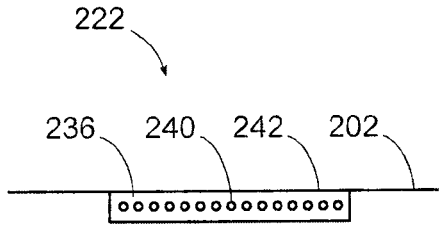
FIG. 5 is a cross-sectional view of a portion of the fan blade of FIG. 3, viewed along section line 5-5.

As best shown in FIGS. 4 and 5, material 236 positioned within recess 232 is a tape incorporating fibers (e.g., fiber 240). In this embodiment, the tape is secured to the recess by a hot isothermal press (HIP) bonding process, although various other techniques can be used for securing the material to one or more surfaces forming a corresponding recess. For instance, diffusion bonding could be used.

As shown in FIG. 5, an outer surface 242 of material 236 is generally flush with the exterior airfoil shape of pressure side 202. In other embodiments, the material may be countersunk or may protrude to various extents from the recess. Note also that the fiber orientation is generally aligned with the major axis of the material. However, in other embodiments, various other fiber orientations can be used.

Mechanical properties of the stiffening materials (e.g., high modulus of elasticity and strength) combined with the stiffening locations allow for tailoring of a blade's vibratory characteristics. This aero-elastic tailoring or tuning can be used to modify a blade's susceptibility to blade flutter and/or other undesirable vibratory modes.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A gas turbine engine blade comprising:

a first recess located in a pressure side surface of the blade;

a second recess located in a suction side surface of the blade;

a first material positioned at least partially within the first recess such that the first material provides a first localized increase in stiffness of the blade;

a second material positioned at least partially within the second recess such that the second material provides a second localized increase in stiffness of the blade;

wherein the first recess and the second recess are oriented substantially not parallel to each other.

2. The blade of claim 1, wherein the first material is a composite material comprising fibers.

3. The blade of claim 2, wherein:

the first recess exhibits a major axis; and the fibers are substantially aligned with the major axis of the first recess.

4. The blade of claim 1, wherein:

the first material is mounted flush with the pressure side surface of the blade.

5. The blade of claim 1, wherein the blade is formed of titanium and one of the first material or the second material comprises a titanium metal matrix composite.

6. The blade of claim 1, wherein the blade is a fan blade.

7. The blade of claim 1, wherein the second material is a composite material comprising fibers.

8. The blade of claim 7, wherein:

the second recess exhibits a major axis; and the fibers are substantially aligned with the major axis of the second recess.

9. The blade of claim 1, wherein:

the second material is mounted flush with the suction side surface of the blade.

10. A gas turbine engine comprising:

a blade having a pressure side surface and a suction side surface;

a first recess located in the pressure side surface of the blade;

a second recess located in the suction side surface of the blade;

a first material positioned at least partially within the first recess such that the material provides a first localized increase in stiffness of the blade;

a second material position at least partially within the second recess such that the material provides a second localized increase in stiffness of the blade; and wherein the first recess and the second recess are oriented substantially not parallel to each other.

11. The engine of claim 10, wherein:

the engine comprises a fan; and the blade is a blade of the fan.

12. The engine of claim 10, further comprising a differential gear operative to drive the fan.

13. A method comprising:

stiffening discrete portions of a blade of a gas turbine engine such that aeroelastic tuning of the blade is facilitated, wherein stiffening comprises:

forming a first recess in a pressure side surface of the blade and a second recess in a suction side surface of the blade, wherein the first recess and the second recess are oriented substantially not parallel to each other;

positioning a first material in the first recess to selectively stiffen the blade in a vicinity of the first recess;

positioning a second material in the second recess to selectively stiffen the blade in a vicinity of the second recess.

14. The method of claim 13, wherein forming the first recess comprises:

providing the blade without the first recess; and producing the first recess in the pressure side surface of the blade.

15. The method of claim 13, wherein one of the first material or the second material is a composite material comprising fibers.

16. The method of claim 15, wherein the composite material is a silicon carbide fiber tape.

17. The method of claim 13, wherein, in stiffening the discrete portions of a blade, a tendency of the blade to exhibit flutter during use is reduced.

18. The method of claim 13, wherein forming the second recess comprises:

providing the blade without the second recess; and producing the second recess in the suction side surface of the blade.

* * * * *